United States Patent [19]

Macaulay

[11] Patent Number: 4,943,554

[45] Date of Patent: Jul. 24, 1990

[54] CARBONLESS COPYING SYSTEM AND METHOD OF PRODUCING MULTIPLE COLORED COPY IMAGES THEREWITH

[75] Inventor: Norman Macaulay, Tonawanda, N.Y.

[73] Assignee: Moore Business Forms, Inc., Grand Island, N.Y.

[21] Appl. No.: 198,070

[22] Filed: May 24, 1988

[51] Int. Cl.[5] ..... B41M 5/22

[52] U.S. Cl. ..... 503/201; 427/150; 427/151; 427/152; 503/204; 503/206; 503/226

[58] Field of Search ..... 427/150–152; 428/914; 503/200, 204, 206, 226, 201

[56] References Cited

U.S. PATENT DOCUMENTS

| | | | |
|---|---|---|---|
| Re. 30,116 | 10/1979 | Maalouf | 427/150 |
| 3,364,052 | 1/1968 | Martino | 503/205 |
| 3,565,005 | 2/1971 | Knott | 503/204 |
| 3,914,511 | 10/1975 | Vassiliades | 503/206 |
| 4,172,605 | 10/1979 | Welsch et al. | 427/150 |
| 4,532,200 | 7/1985 | Arney et al. | 503/205 |
| 4,596,996 | 6/1986 | Sandberg et al. | 503/207 |
| 4,597,993 | 7/1986 | Okada et al. | 427/150 |
| 4,636,818 | 1/1987 | Jerabek | 503/213 |
| 4,662,651 | 5/1987 | Mowry, Jr. | 283/70 |

*Primary Examiner*—Bruce H. Hess

*Attorney, Agent, or Firm*—Finnegan, Henderson, Farabow, Garrett and Dunner

[57] ABSTRACT

A carbonless copy system which enables the formation of a plurality of different colored images on a substrate. A phenolic resin or reactive clay image-forming component is applied as a CF coating on a recording substrate. One or more coatings of encapsulated dye precursors (complementary image-forming components) are applied to selected portions of the CF coating on the recording substrate and one or more coatings of encapsulated dye precursors are applied to selected portions of a transfer substrate. The dye precursor coatings are capable of forming different colored reaction products when coming into contact and reacting with the phenolic resin or reactive clay. Upon applying pressure to the transfer substrate, the dye precursor capsules are ruptured, releasing the dye precursor which contacts and reacts with the phenolic resin or reactive clay to form the colored reaction products.

12 Claims, 1 Drawing Sheet

CARBONLESS COPYING SYSTEM AND METHOD OF PRODUCING MULTIPLE COLORED COPY IMAGES THEREWITH

BACKGROUND OF THE INVENTION

The present invention relates to carbonless copying systems, and more specifically, a carbonless copying system which enables the formation on a substrate, e.g., on a sheet of paper, of images having three or more different colors.

As described in U.S. Pat. No. 4,636,818, standard carbonless copying systems include a plurality of substrates, e.g., paper sheets, arranged in a manifold, each sheet having one or more coatings on its surface. The manifold is designed so that when external pressure caused by a typewriter, pen, or other instrument is applied to the outermost sheet, a colored image will be formed on at least one surface of each sheet of the manifold.

The top sheet of the manifold to which the pressure is applied has a coating on its back surface. This coated back surface includes microcapsules containing an initially colorless chemically reactive color-forming dye precursor as the fill material. The front surface of the next sheet, which is adjacent to the back surface of the top sheet, is coated with a material containing a component, such as phenolic resin or reactive clay, that is capable of reacting with the colorless dye precursor contained in the microcapsules to produce a color. Thus, an external pressure on the front surface of the top sheet will rupture the microcapsules on the back surface and release the colorless dye precursor which then chemically reacts with the reactive component of the coated front of the adjacent sheet to produce a colored image corresponding to the area of pressure. Similarly, colored images are produced on each successive sheet of the manifold by the external pressure rupturing the microcapsules carried on the bottom surface of each sheet.

The sheets of the carbonless copying system manifold are designated in the art by the terms CB for "coated back", CFB for "coated front and back", and CF for "coated front". The CB or transfer sheet is usually the top sheet of the manifold and the sheet to which the external pressure is applied. The CFB sheets are the intermediate sheets of the manifold, each of which is able to have an image formed on its front surface by a pressure, and each of which also transmits the contents of ruptured microcapsules from its back surface to the front surface of the next sheet. The CF or recording sheet is the bottom sheet and is coated only on its front surface so that an image can be formed on it.

While it is customary to have the coating containing the microcapsules on the back surface of the sheets and to have the coating containing the reactive component for the capsules on the front surface of each of the sheets, the reverse arrangement is also possible. In addition, one of the reactive ingredients may be carried in the sheets themselves, rather than applied as surface coatings. Furthermore, the component that reacts with the colorless dye precursor may also be microencapsulated.

The microcapsules used in carbonless copying systems generally comprise a core of fill material surrounded by a wall or shell of polymeric material. The wall surrounding the fill material acts to isolate the fill material from the external environment. To release the fill material, e.g., the dye precursor, the capsule wall may be ruptured by an external pressure such as mechanical pressure, thereby introducing the fill material into its surroundings. Generally, the microcapsules comprise separate and discrete capsules having non-interconnecting hollow spaces. The fill material is thus enveloped within the generally continuous polymeric walls of the microcapsules, which may range from about 0.1 to about 500 microns in diameter.

For many years, carbonless copy systems of the prior art utilized a standard encapsulated carbonless dye, crystal violet lactone. This was not entirely satisfactory because photocopying machines often could not distinguish the blue color. Black dyes were subsequently developed to solve the photocopy problems; however, these dyes were quite expensive. Both of these systems suffered from the disadvantage that only one color could be formed on the copy sheet.

There has been a need in the carbonless copy field for a system that will enable the formation of multiple colors on a sheet, a given color to be formed only in a selected region of the sheet. Carbonless copy systems have been disclosed whereby only selected areas or regions of a sheet would receive a colored image. These systems are disclosed, for example, in U.S. Pat. No. 4,597,993 to Okada et al., U.S. Pat. No. 4,532,200 to Arney et al., U.S. Pat. No. Re. 30,116 to Maalouf and U.S. Pat. No. 3,364,052 to Martino. However, these patents do not disclose a carbonless copy system that enables the formation of multiple colors on the sheets, with a given color to be formed only in selected regions of the sheets.

It is an object of the present invention to provide a carbonless copy system that enables the formation of multiple colored images on a recording sheet, with each colored image capable of being formed in selected regions of the recording sheet.

It is another object of the present invention to provide a carbonless copy system that enables the formation of three different colors on a recording sheet utilizing only two different dye capsules.

It is a further object of the present invention to provide a carbonless copy system that enables the formation of n! different colors on a recording sheet utilizing only n different dye precursor materials.

SUMMARY OF THE INVENTION

To achieve the foregoing objects, and in accordance with the purposes of the invention as embodied and broadly described herein, the present invention provides a carbonless copying system comprising a recording substrate, a first image-forming component, and a plurality of complementary image-forming components, each complementary component being encapsulated in a microcapsule having generally continuous walls, and each complementary component being capable of reacting with the first image-forming component to produce a colored reaction product. The first image-forming component and the plurality of complementary image-forming components are arranged in juxtaposed contact with one another whereby the application of pressure in selected areas upon the carbonless system causes a colored image to form on corresponding areas of the recording substrate.

The accompanying drawing, which is incorporated in and constitutes a part of this specification, illustrates one embodiment of the invention and, together with the description, serves to explain the principles of the invention.

DETAILED DESCRIPTION OF THE PREFERRED EMBODIMENTS

Figure 1:
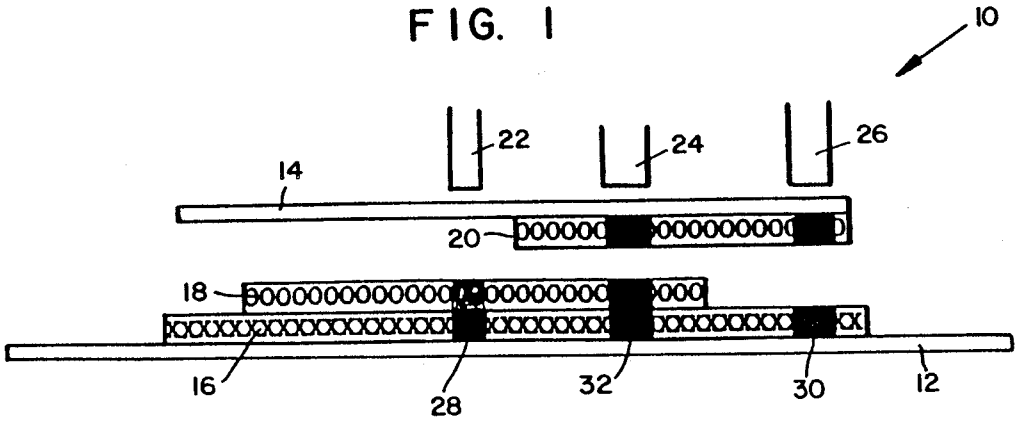
FIG. 1 is a diagram of a preferred embodiment of the carbonless copy system in accordance with the present invention.

Reference will now be made in detail to the presently preferred embodiments of the invention, an example of which is illustrated in the accompanying drawing.

In accordance with one embodiment of the present invention as shown in FIG. 1, there is provided a carbonless copy system 10 having a recording substrate 12, a transfer substrate 14, a first image-forming component 16, a complementary image-forming component 18 and another complementary image-forming component 20. First image-forming component 16 takes the form of a coating applied to the front or CF portion of recording substrate 12. Representative materials which may be used as the first image-forming component 16 in accordance with the invention include, for example, clays, treated clays (U.S. Pat. Nos. 3,622,364 and 3,753,761), aromatic carboxylic acids such as salicylic acid, derivatives of aromatic carboxylic acids and metal salts thereof (U.S. Pat. No. 4,022,936), phenolic developers (U.S. Pat. No. 3,244,550), acidic polymeric material such as phenol-formaldehyde polymers, etc. (U.S. Pat. Nos. 3,455,721 and 3,672,935), and metal-modified phenolic resins (U.S. Pat. Nos. 3,732,120 and 3,737,410). Preferably, first image-forming component 16 comprises an acidic clay or a phenolic resin.

First image-forming component 16 can be applied to recording substrate 12 by, for example, utilizing a binder such as starch/latex to adhere the phenolic resin or acidic clay thereto. Complementary image-forming components 18 and 20 take the form of different colorless dye precursors encapsulated in microcapsules. Representative colorless dye precursors include, for example, crystal violet lactone, benzoyl leucomethylene blue, rhodamine lactam, the p-toluene sulfinate of Michler's hydrol, and any of the various chromogenic compounds that are capable of changing from a colorless to a colored form on contact with an acidic substance, such as a phenolic resin or a reactive clay.

The microcapsules utilized for enveloping the dye precursor material may comprise a shell or wall of polymeric material, may have generally continuous walls and may range from about 0.1 to about 500 microns in diameter. Complementary image-forming component 18 is adhered to a selected portion of first image-forming component 16 by utilizing any binder material known in the art for preparing microcapsular coatings, such as a polyvinyl alcohol binder. Complementary image-forming component 20 can be adhered to a selected portion of transfer substrate 14 by utilizing a known binder, such as a polyvinyl alcohol.

The microcapsule walls may be ruptured by the application of pressure, such as that caused by a pen or other writing implement, or a printing device such as a typewriter. Upon rupture of the microcapsules, the dye precursor material is introduced into its surroundings. Complementary image-forming components 18 and 20, which take the form of dye precursors, are capable of reacting with first image-forming component 16, i.e., the phenolic resin or reactive clay, to produce a colored reaction product.

Recording substrate 12 and transfer substrate 14 are arranged adjacent to one another so that first image-forming component 16 and the complementary image-forming components 18 and 20 are in juxtaposed, i.e., pressure-sensitive, contact with respect to one another. Complementary image-forming component 18 is applied to a selected portion of first image-forming component 16 on recording substrate 12 and complementary image-forming component 20 is applied to a selected portion of transfer substrate 14.

In operation, when pressure is applied at position 22 on transfer substrate 14, microcapsules of complementary image-forming component 18 are ruptured and the contained dye precursor is released to contact and react with first image-forming component 16 on recording substrate 12 to form a first colored reaction product 28 thereon. When pressure is applied at position 26 on transfer substrate 14, microcapsules of complementary image-forming component 20 are ruptured and the contained dye precursor is released to contact and react with first image-forming component 16 on recording substrate 12 to form a second colored reaction product 30 thereon. Second colored reaction product 30 has a color different from that of first colored reaction product 28. Similarly, when pressure is applied at position 24 on transfer substrate 14, microcapsules of both of complementary image-forming components 18 and 20 are ruptured and the contained dye precursors are released to contact and react with first image-forming component 16 on recording substrate 12 to form a third colored reaction product 32 thereon. Third colored reaction product 32 has a color obtained by combining the colors of first and second colored reaction products 28 and 30. Thus, by utilizing only two different colorless dye precursors, the carbonless copy system of the present invention enables the formation of three different colors on recording substrate 12.

In accordance with another embodiment of the invention, there is provided a carbonless copy system 10 having only a recording substrate 12, i.e., without a transfer substrate 14 (not shown). In this embodiment, recording substrate 12 would contain first image-forming component 16 and at least one complementary image-forming component 18. The external pressure would be applied to recording substrate 12 causing the microcapsules containing complementary image-forming component 18 to rupture, thus releasing complementary image-forming component 18 which then contacts and reacts with first image-forming component 16 to form first colored reaction product 28.

In accordance with the invention, the carbonless copy system may also contain a plurality of intermediate substrates, or CFB (coated front and back) sheets (not shown), located between transfer substrate 14 and recording substrate 12. These intermediate substrate sheets are coated on the front side with image-forming components corresponding to first image-forming component 16 and complementary image-forming component 18 on recording substrate 12, and are also coated on the back side with a complementary image-forming component corresponding to complementary image-forming component 20 on transfer substrate 14. Thus, the intermediate sheets are capable of functioning as both recording and transfer sheets by forming the three colored reaction products on their front side like recording substrate 12, and they also enable the transfer of the complementary image-forming component 20 to successive sheets, like transfer substrate 14. This enables the formation of multiple copies of sheets, each sheet containing three different colored images.

In accordance with the invention, the carbonless copy system may also contain more than two complementary image-forming components, i.e., more than two image-forming components containing dye precursors. Transfer substrate 14 may contain more than one complementary image-forming component containing a dye precursor and recording substrate 12 may also contain more than one complementary image-forming component containing a dye precursor. All of the image-forming components can be applied only to selected portions of the substrates to enable the formation of a plurality of desired colored images on selected portions of the recording substrate. Utilizing n different complementary image-forming components, each containing a different dye precursor, it would be possible to provide n! (n factorial) different colored reaction products on recording substrate 12.

Although the present invention has been described in connection with preferred embodiments, it is understood that modifications and variations may be resorted to without departing from the spirit and scope of the invention. Such modifications are considered to be within the purview and scope of the invention and the appended claims.

What is claimed is:

1. A carbonless copying system comprising:

a recording substrate, a first image-forming component, and a plurality of complementary image-forming components, each encapsulated in a microcapsule having generally continuous walls, and each capable of chemically reacting with said first image-forming component to produce a colored chemical reaction product, said first image-forming component and said plurality of complementary image-forming components being arranged in juxtaposed contact with one another whereby the application of pressure in selected areas upon the carbonless system causes a colored image to form on corresponding areas of said recording substrate.

2. The carbonless copying system of claim 1, wherein said first image-forming component is an acidic clay or phenolic resin and is carried by said recording substrate.

3. The carbonless copying system of claim 2, wherein said complementary image-forming components are colorless dye precursors.

4. The carbonless copying system of claim 1, further comprising a transfer substrate, wherein at least one of said plurality of complementary image-forming components is carried by a selected portion of said transfer substrate.

5. The carbonless copying system of claim 4, wherein at least one of said complementary image-forming components is carried by a selected portion of said recording substrate.

6. The carbonless copying system of claim 5, comprising two complementary image-forming components.

7. The carbonless copying system of claim 6, wherein one of said two complementary image-forming components forms a first colored chemical reaction product when reacted with said first image-forming component and the other of said two complementary image-forming components forms a second colored chemical reaction product different from said first colored chemical reaction product when chemically reacted with said first image-forming component.

8. The carbonless copying system of claim 7, wherein in first selected areas of pressure one of said two complementary image-forming components chemically reacts with said first image-forming component to form said first colored chemical reaction product, wherein in second selected areas of pressure the other of said two complementary image-forming components chemically reacts with said first image-forming component to form said second colored chemical reaction product, and wherein in third selected areas of pressure both of said complementary image-forming components chemically react with said first image-forming component to form a third colored chemical reaction product.

9. A method of producing copy images having a plurality of different colors, comprising applying a first image-forming component to a recording substrate;

applying at least one of a plurality of complementary image-forming components to a selected portion of a transfer substrate, each of said plurality of complementary image-forming components being encapsulated in microcapsules and being capable of forming a different colored reaction product when reacting with said first image-forming component;

applying at least one other of said plurality of complementary image-forming components to a selected portion of said recording substrate over said first image-forming component;

positioning said recording substrate and said transfer substrate whereby said first and said plurality of complementary image-forming components are arranged in juxtaposed contact with one another;

applying pressure to selected locations of said transfer substrate to rupture the microcapsules of at least one of said plurality of complementary image-forming components whereby said component comes into contact with said first image-forming component on said recording substrate to form selected colored reaction products on the corresponding locations on said recording substrate.

10. The method of claim 9, wherein said plurality of complementary image-forming components are colorless dye precursors.

11. The method of claim 10, wherein said first image-forming component is an acidic clay or phenolic resin.

12. The method of claim 11, comprising two complementary image-forming components.

* * * * *